United States Patent [19]

Tengler et al.

[11] Patent Number: 4,781,620

[45] Date of Patent: Nov. 1, 1988

[54] FLAT RIBBON COAXIAL CABLE CONNECTOR SYSTEM

[75] Inventors: John N. Tengler; Roy A. Gobets; Chris A. Shmatovich, all of Chico; Ross A. Tessien, Grass Valley, all of Calif.

[73] Assignee: Minnesota Mining and Manufacturing Company, St. Paul, Minn.

[21] Appl. No.: 15,977

[22] Filed: Feb. 18, 1987

[51] Int. Cl.[4] ..... H01R 9/05; H01R 9/07; H01R 13/652; H01R 23/66

[52] U.S. Cl. ..... 439/497; 29/858

[58] Field of Search ..... 439/492-497; 29/857, 858

[56] References Cited

U.S. PATENT DOCUMENTS

| | | | |
|---|---|---|---|
| 4,094,564 | 6/1978 | Cacoliu | 439/497 X |
| 4,365,856 | 12/1982 | Yaegashi et al. | 439/497 |
| 4,406,512 | 9/1983 | Schell | 439/497 |
| 4,605,276 | 8/1986 | Aasircoglu | 439/497 X |

*Primary Examiner*—Eugene F. Desmond

*Attorney, Agent, or Firm*—Renner, Otto, Boisselle & Sklar

[57] ABSTRACT

A cable connector assembly and related method characterized by a flat ribbon insulated coaxial multiconductor cable including multiple conductors and respective coaxial shields therefor, plural contacts electrically connected to respective conductors, a grounding bus for electrically connecting the coaxial shields, and an insulating body for holding together the cable, plural contacts and grounding bus. The contacts are held by the insulating body in a dual-in-line pattern and the contacts in each row are connected to respective conductors alternating with conductors connected to contacts in the other row. The grounding bus includes a plurality of fingers, alternate ones of which engage oppositely disposed sides of respective relatively adjacent coaxial shields. The fingers are arranged along one side of a main portion of the grounding bus which extends widthwise of the cable and is interposed between the end portions of relatively adjacent ones of the conductors and preferably between the two rows of contacts in coextensive relationship to terminal end portions of the contacts.

21 Claims, 2 Drawing Sheets

FLAT RIBBON COAXIAL CABLE CONNECTOR SYSTEM

The invention herein disclosed relates generally to connector systems for terminating flat ribbon multiconductor cables of the type having signal and ground conductors and, more particularly, to a connector system for terminating flat ribbon insulated coaxial multiconductor cable.

BACKGROUND

The use of flat ribbon multiconductor electrical cables in the electronics industry is widespread. Such cables typically include a plurality of parallel electrical conductors maintained generally in a common plane and electrically isolated from each other by a ribbon-like body of electrical insulation. The external surfaces of such cable may be flat, convoluted or a mixture thereof. In one known shielded type of such cables, the conductors consist of plural signal conductors and one or more shield conductors for each signal conductor. Several electrical connectors have been employed to terminate shielded type of flat ribbon multiple conductor cable. One such connector disclosed in U.S. Pat. No. 4,094,564 includes therein a grounding bus to afford a common ground connection for the ground conductors while the signal conductors are connected to respective contacts of the connector for signal carrying purposes. The grounding bus, which may be connected to one or more contacts for connection to an external circuit ground, eliminates the need to provide an individual contact for each ground conductor.

Also known is flat ribbon insulated coaxial multiconductor cable including multiple signal conductors and respective coaxial shields therefor. Each signal conductor is individually insulated with respect to its coaxial shield to form a coaxial conductor pair and the plural coaxial conductor pairs are maintained in a common plane and electrically isolated from each other by an outer ribbon-like body of electrical insulation. Respecting termination of this type of cable as by connection of the conductors thereof to respective electrical contacts of an electrical connector, the coaxial arrangement of the signal conductors and shields presents problems different from those associated with the termination of cables wherein the shield conductors are disposed between the signal conductors in the plane of the signal conductors. For example, the signal conductors cannot be simply bent out of the plane of the cable for connection to a contact and the coaxial shield continued in the plane of the cable for connection, for example, to a grounding bus. For these and other reasons, connectors for flat ribbon cables wherein the shield conductors are disposed between the signal conductors in the plane thereof are generally unsuitable for terminating flat ribbon insulated coaxial multiconductor cable.

SUMMARY

According to one aspect of the invention a novel technique for bussing the coaxial shields of a coaxial multiconductor cable, particularly flat cable, is provided.

The present invention provides a connector, connector assembly and method for termination of flat ribbon insulated coaxial multiconductor cable in such a manner that achieves desired close packing of contacts in the connector for the cable while maintaining electrical isolation of the signal conductors. The connector also maintains separation of the signal conductors from the grounding structure of the shields and a grounding bus. Provision also is made for common connection of the coaxial shields to the grounding bus which may be programmed for selective connection to a respective one or more contact and/or signal conductors coupled to such respective contacts for desired connection to an external circuit ground. Relative isolation of adjacent signal conductors in the cable may also be preserved at the interface between the cable and the contacts of the connector due to an alternating offset directing of such signal conductors to contacts on opposite sides of the grounding bus.

The grounding bus preferably is wider than those used in most conventional electrical connectors, and this characteristic reduces the inductance of the bus. Also, by making a connection from a generally central part of the bus to a ground contact(s), the path length for the ground current carried by the bus generally is minimized; and this, in turn, reduces the common mode inductance associated with common bussing of signals.

By connecting the grounding contact(s) to such central area of the bus, e.g. using a dimple or like part of the bus to engage the contact(s), the crosstalk caused by the connector when any line is driven, as measured on other non-driven or quiet lines is reduced and/or generally is minimized. Since crosstalk is reduced, the number of contacts that otherwise might have to be dedicated to ground is reduced, thus increasing the number of contacts for signal connecting use.

Briefly, a cable connector assembly according to the present invention comprises a flat ribbon insulated coaxial multiconductor cable including multiple conductors and respective coaxial shields therefor, plural contacts electrically connected to respective ones of the conductors, a grounding bus for electrically connecting a plurality of the coaxial shields, and an insulating body for holding together the cable, plural contacts and grounding bus.

More particularly, the contacts are held by the insulating body in a dual-in-line pattern and the contacts in each row are connected to respective conductors alternating with conductors connected to contacts in the other row. The grounding bus is characterized by a plurality of fingers, alternate ones of which engage oppositely disposed sides of respective relatively adjacent coaxial shields. As is preferred, alternate ones of the individually insulated signal conductors have end portions thereof angled out of the plane of the cable in opposite directions for connection to the contacts in the respective rows thereof, and alternate ones of the fingers are similarly angled for engaging respective coaxial shields at portions thereof coextensive with a part of the angled end portions of the respective conductors. The fingers are arranged along one side of a main portion of the grounding bus which main portion extends widthwise of the cable and is interposed between the end portions of relatively adjacent ones of the conductors and preferably between the two rows of contacts in coextensive relationship to terminal end portions of the contacts.

The foregoing and other features of the invention are hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION

Figure 1:
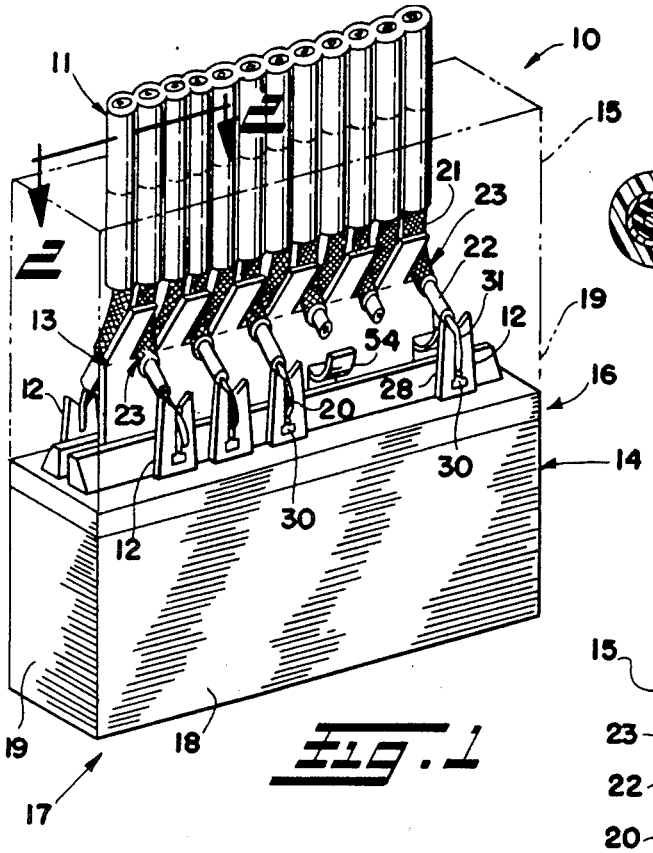
FIG. 1 is an isometric view, partly broken away, of an electrical cable connector assembly according to the invention with the molded strain relief removed but outlined by phantom lines.

Referring now in detail to the drawings and initially to FIG. 1, a cable connector assembly or cable termination assembly according to the invention is indicated generally at 10. The cable connector assembly 10 generally includes a flat ribbon coaxial multiconductor cable 11, a plurality of contacts 12, a grounding bus 13 and a contact housing 14, as are illustrated in FIG. 1. The connector assembly also includes a strain relief body 15 which is outlined by phantom lines in FIG. 1 and shown in section in FIG. 3. The contacts 12, grounding bus 13, contact housing 14 and strain relief body 15 may be considered an electrical connector portion 16 of the assembly for terminating the cable 11. The assembly 10 has a leading or front end 17, top and bottom sides 18 and laternal ends 19. The strain relief body 15 is at the back end.

Figure 2:
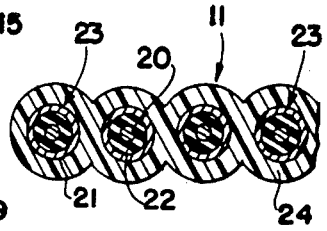
FIG. 2 is a fragmentary transverse sectional view of the cable taken substantially along the line 2—2 of FIG. 1.

The connector 16 is particularly suited for terminating cable of the noted type which cable 11 includes a plurality of signal conductors 20 circumscribed by respective coaxial shields 21 as seen in FIG. 2. Each signal conductor 20 is electrically isolated from and maintained concentric with its respective coaxial shield 21 by individual inner insulation 22. Together, each signal conductor and coaxial shields form what is herein denoted a coaxial conductor pair 23. Accordingly, the cable includes a plurality of coaxial conductor pairs 23 which are contained in and electrically isolated from each other by outer cable insulation 24.

Exemplary use of the cable 11 would be the transmission of high speed electrical signals carrying information or data. Such signals are carried on one or more of the signal conductors 20, and electrical isolation/shielding therefor ordinarily is provided by the coaxial shields 21 which typically are coupled to a source of reference potential, such as to a ground. For purposes of this detailed description, such exemplary use of the cable will be assumed. However, it will be understood that the cable may be used for other purposes as well.

Figure 3:
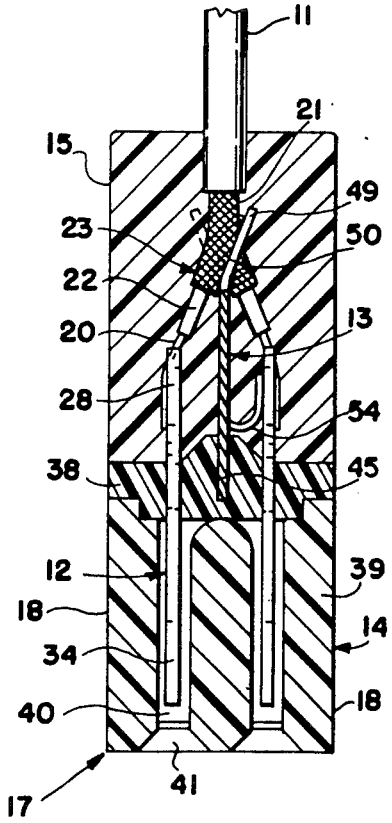
FIG. 3 is a longitudinal sectional view of the connector assembly.

At the connector end of the cable 11, the outer insulation 24 is stripped therefrom to free bared end portions of the coaxial conductor pairs 23 from one another. The bared end portions of such conductor pairs 23 are alternately bent in opposite directions out of the plane of the cable for extension of the signal conductors 20 thereof to respective contacts 12 supported by the contact housing 14 in a dual-in-line pattern. As is shown in FIG. 3, the coaxial conductor pairs generally angle out at the plane of the cable in similar manner, although alternately in opposite directions, for desired centered positioning of the plane of the cable with respect to the center plane of the contact housing. It will be appreciated, however, that the plane of the cable may be offset to either side of the central plane of the housing, as desired, as by varying the extent to which the bared end portions of the coaxial conductor pairs are alternately oppositely angled out of the plane of the cable.

As is seen in FIGS. 1 and 3, the bared end portion of each coaxial conductor pair 23 is further stripped in stepped manner so that the signal conductor 20 protrudes forwardly from the inner insulation 22 at a point axially forward of a bared portion of the coaxial shield 21. At its bared terminal end portion, the signal conductor 20 is electrically connected to a terminal portion 28 of the respective contact 12. In the illustrated embodiment, the terminal portion of each contact includes a pair of arms separated by a slot 30 with the arms and slot being cooperable to receive the bared terminal end portion of the respective signal conductor to form an electrical junction 31 therewith. Preferably adequate length of inner insulation 22 is allowed to remain on the signal conductors 20 to assure electrical isolation and, thus, to avoid short circuits of such signal conductors where they exit the protective environment beneath the coaxial shield 21 until they are in close proximity to respective contacts 12. Each signal conductor is preferably soldered to a contact 12. It will be appreciated that other means may be employed to provide a suitable electrical junction between the signal conductor and contact, for example the close fit of the conductor 20 to the contact in the slot 30, welding, and/or other means.

The contacts 12, which preferably are identical, include in addition to the terminal portion 28 a contacting portion 34 for electrically connecting with a contact element of an external device. In the illustrated connector assembly, the contacting portion 34 is of female type, for example, a conventional fork contact into which a conventional pin contact may be inserted for electrical engagement therewith. It however will be appreciated that the connecting portion may be of male type, for example, in the form of a pin with the contact housing 14 being appropriately reconfigured.

With regard to the contact housing 14, the same may be of any suitable form which serves electrically to isolate the contacts 12 and to support the same preferably in a dual-in-line pattern, although if desired other patterns may be employed using the same or different number of rows of contacts. By way of example, the contact housing 14 may include a contact carrier body 38 molded, for example, by injection molding techniques, directly about at least a portion of each of the contacts to secure them in the illustrated dual-in-line pattern. The carrier body 38 may be formed of any suitable insulating material having desired strength and dielectric properties. The contact housing 14 further may include a cover 39 secured to the contact carrier body 38 for example by ultrasonic welding. The cover 39 includes a plurality of compartments 40 for accommodating the contacting portion 34 of respective contacts with openings 41 providing respective entranceways for guiding, for example, pin contacts into the compartments for mechanical and electrical engagement with respective connecting portions of the contacts.

As can be seen in FIGS. 1 and 3, the carrier body 38 has a central portion that separates the two rows of contacts 12 and which includes an elongate groove 45 adapted to receive the axially forward edge portion of the grounding bus 13. The grounding bus 13 provides a common ground connection for the coaxial shields 21.

Figure 4:
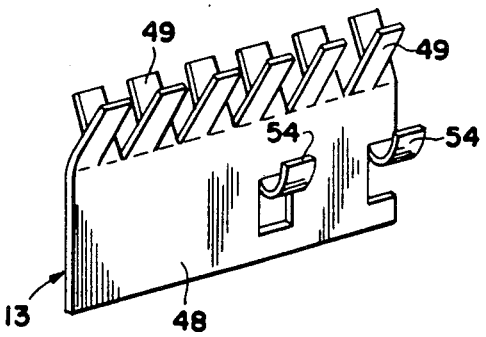
FIG. 4 is a isometric view of the grounding bus employed in the connector assembly.

As is seen in FIGS. 1, 3 and 4, the grounding bus 13 has a base strip portion 48 and a plurality of axially rearwardly extending tab-like fingers 49 arranged in a row extending widthwise of the cable 11 when assembled with respect thereto. The grounding bus may be formed from a flat strip of electrically conductive material which is slit along one edge to form the row of fingers 49. The fingers at their point of integral joinder to the base strip portion are alternately bent in opposite directions at an angle to the plane of the base strip portion. More particularly, each finger is bent to extend generally parallel to the bent bared portion of a respective coaxial shield 21 for juxtapositioning therewith.

As will be appreciated, alternate ones of the fingers 49 engage oppositely disposed sides of respective coaxial shields 21. That is, each finger extends generally parallel to and engages a side of the respective coaxial shield which side is opposite the side of the coaxial shield engaged by the next adjacent finger. Preferably the fingers are attached as by soldering to the coaxial shields to provide a mechanically secure electrical junction 50 therebetween.

With the grounding bus 13 assembled to the cable 11 as shown, the base strip portion 48 thereof extends forwardly beyond the coaxial shields 21 to continue ground isolation between relatively adjacent signal conductors 20 over the lengths from which their coaxial shields have been removed. The base strip portion 48 also extends between the terminal portions 28 of each pair of opposed contacts 12 to which relatively adjacent signal conductors are connected. It also can be seen in FIGS. 1 and 3 that the terminal portions of contacts in one row thereof are located at one side of the base strip portion and those of contacts in the other row are located at the other side of the base strip portion.

With continuing reference to FIGS. 1, 3 and 4, and grounding bus 13 further may include one or more interconnect devices 54. In the illustrated embodiment, the interconnect devicdes 54 are in the form of tabs extending outwardly from the plane of the base strip portion 48 for connection with respective contacts 12 and/or signal conductors 20. The tabs 54 may be formed, as shown, from the base strip portion 48 and bent to abut the respective contacts at the terminal portions 28 thereof and, as is preferred, solder may be applied around the tabs, respective contacts and respective signal conductors to connect them mechanically and electrically. Ordinarily the grounding bus will be thusly connected to at least one contact for connection to an external circuit ground and to at least one signal conductor.

The curved tabs 54 may provide a resilient locating mechanism, too, helping to center the grounding bus 13 between the parallel rows of contacts 12. Such centering is particularly facilitated if there is one or more tabs 54 extending toward one row of contacts 12 and one or more tabs extending toward the other row of contacts.

Although it will be appreciated that various methods may be employed to assemble together the components of the cable connector assembly 10, one exemplary method involves stripping the cable 11 as shown while leaving the freed or separated portions of the coaxial conductor pairs 23 in the plane of the cable. Prior to attachment of the grounding bus 13 to the coaxial shields 21, the grounding bus may be assembled to the carrier body 38 in proper position as by insertion into the groove 45 molded into the carrier body. Alternatively, the grounding bus may be directly molded into the carrier body along with the contacts, if desired.

The extent that the base strip portion 48 of the grounding bus extends to or toward the leading end 17 of the cable connector assembly 10 can be varied as a function, for example, of the design of the carrier 38 and/or of the housing 14. As one example, such base strip portion 48 may extend through the carrier 38 into a groove, slot or space in the housing 14 between the rows of contacts 12. As another example, the carried 38 may include a tongue of insulation covering the base strip portion 48 and extending into a space that accommodates the same in the housing 14.

The resultant contact carrier sub-assembly 12, 13, 38 then may be positioned with respect to the cable 11 such that upon relative axial movement together the bent fingers 49 engage respective coaxial conductor pairs 23 and cause the latter alternately to be urged in a cam-like manner in opposite directions out of the plane of the cable as the fingers move towards and into engagement with the respective coaxial shields 21. Preferably the fingers have been precoated with solder in which case heat may be applied to the grounding bus to form the solder junctions 50 between the fingers and the coaxial shields. Also, the bare terminal end portion of each signal conductor 20 may be properly disposed within the slot 30 of the respective contact 12 and solder applied around the signal conductor and contact and, if associated therewith, a respective tab 54 of the grounding bus. After the several soldered connections have been effected, the strain relief body 15 may be applied as by injection molding directly to and about the cable 11, the exposed portions of the contacts 12 and the exposed portion of the grounding bus 13 as shown. Consequently and desirably, the strain relief body seals the respective electrical junctions of the signal conductors with the contacts, of the tabs with the contacts and/or signal conductors, and of the coaxial shields with the fingers of the grounding bus. Moreover, preferably the strain relief body 15 and contact body 38 (and preferably the outer insulation 24 of the cable 11) are of compatible materials which chemically bond during molding of the strain relief body so as to form an integral composite body having high mechanical integrity. If desired, at least part of the cable, contacts and grounding bus may be preliminarily potted in conventional potting material prior to molding of the strain relief body; the potting material would protect the cable in particular and the connections of conductors and bus or contacts from the hydraulic crushing forces that may be encountered during injection molding of the strain relief body 15.

Figure 5:
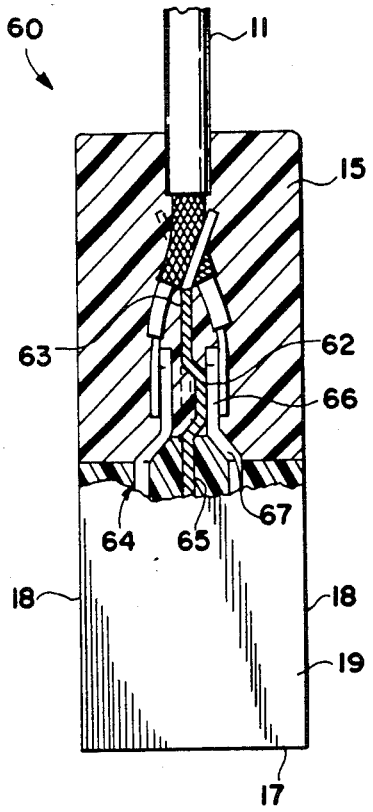
FIG. 5 is a side elevational view, partly broken away in section, of a modified cable connector assembly according to the invention.
Figure 6:
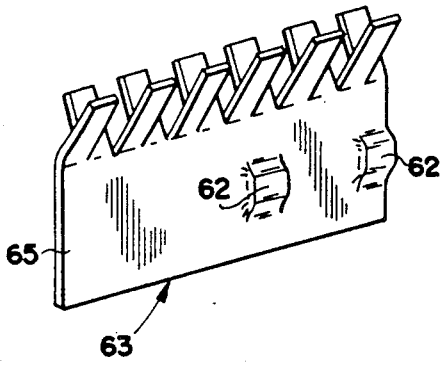
FIG. 6 is an isometric view of the grounding bus employed in the modified connector assembly of FIG. 5.

Referring now to FIGS. 5 and 6, a modified form of cable connector assembly according to the invention is indicated generally at 60. The assembly 60 for the most part is identical to the above described assembly 10 and, therefore, only differences therebetween will be described.

The differences relate primarily to the form of interconnect devices 62 employed to connect the grounding bus 63 to one or more contacts 64. As is shown, the interconnect devices 62 in the assembly 60 are in the form of dimples or bosses provided in the base strip portion 65 by denting the base strip portion at locations corresponding to terminal portions 66 of the contacts to be electrically connected with the grounding bus. The bosses 62 protrude from the plane of the base strip portion for engagement with the terminal portion of respective contacts. The terminal portions 66 of the contacts are inwardly offset by an intermediate angle portion 67 of the major planar extent of the contact to reduce the extent to which the bosses must protrude from the base strip portion for connection to the terminal portions.

It is, of course, well known that in high speed signal transmission circumstances in which transmission line structures, e.g. coaxial cables, are used to carry the signals, characteristics of the traveling wave front are very important. As such high speed signals and wave fronts are transmitted, ground currents occur. The grounding bus 13 of the present invention collects those ground currents. Due to the large dimension of the grounding bus 13 in the horizontal direction, i.e. transversely across the cable 11 or connector assembly 10, preferably beyond the contacts at respective ends or sides 19 of the connector assembly 10, inductance will be generally minimized. Moreover, due to the generally central location of the tabs 54 (FIGS. 1, 3, 4) or dimples 62 (FIGS. 5, 6) the path lengths that ground currents would have to travel on the grounding bus 13 would be generally minimized. This central location (horizontally as viewed in FIGS. 1, 4, 6) together with the location of such interconnection tabs 54 or dimples 62 relatively near the leading end 17 of the assembly 10 help to minimize connector crosstalk problems.

Although the invention has been shown and described with respect to preferred embodiments, it is obvious that equivalent alterations and modifications will occur to those skilled in the art upon the reading and understanding of this specification. The present invention includes all such equivalent alterations and modifications, and is limited only by the scope of the following claims.

What is claimed is:

1. A cable termination assembly comprising a single flat ribbon insulated coaxial multiconductor cable including multiple conductors and respective coaxial shields therefor; plural contacts having a plurality thereof electrically connected to respective ones of said conductors; bus means for electrically connecting a plurality of said coaxial shields; and body means for holding together said single cable, plural contacts and bus means; and wherein relatively adjacent ones of said conductors of said single cable have end portions extending beyond their respective coaxial shields for electrical connection to respective contacts, and said bus means includes a main portion extending across the width of said single cable and interposed between said end portions of said relatively adjacent ones of said conductors of said single cable.

2. An assembly as set forth in claim 1, wherein said respective contacts have terminal portions to which said relatively adjacent ones of said conductors are electrically and mechanically connected, and said main portion of said bus means is also interposed between said terminal portions of said respective contacts.

3. An assembly as set forth in claim 1, wherein said body means includes a strain relief body molded directly to and about at least a part of each of said conductors, coaxial shields, contacts and bus means.

4. An assembly as set forth in claim 1, wherein said bus means includes a main portion extending across the width of said cable and a plurality of fingers arranged generally in a row extending across the width of said cable, and said fingers extend generally parallel to and are electrically connected to respective coaxial shields.

5. An assembly as set forth in claim 1, wherein said body means holds said plural contacts in a dual-in-line pattern, and the contacts in each row are connected to respective conductors alternately with conductors connected to contacts in the other row.

6. An assembly as set forth in claim 5, wherein said bus means includes a plurality of fingers electrically connected to respective coaxial shields.

7. An assembly as set forth in claim 6, wherein alternate ones of said fingers engage oppositely disposed sides of respective coaxial shields.

8. An assembly as set forth in claim 6, wherein alternate ones of said fingers are angled with respect to one another.

9. An assembly as set forth in claim 6, including interconnect means for connecting said bus means to at least one of said plural contacts.

10. An assembly as set forth in claim 9, wherein said body means includes a strain relief body molded directly to and about at least a part of each of said conductors, coaxial shields, contacts and bus means.

11. An assembly as set forth in claim 9, wherein said interconnect means in as integral part of said bus means.

12. An assembly as set forth in claim 10, wherein said interconnect means includes at least one tab bent from said bus means and extending to connect with one of said plural contacts.

13. An assembly as set forth in claim 10, wherein said interconnect means includes a boss-like protrusion formed from said bus means and extending to connect with one of said plural contacts.

14. An electrical cable connector for flat ribbon insulated coaxial multiconductor cable including multiple conductors and respective coaxial shields therefor, said connector comprising plural contact means for electrically connecting respective ones of the conductors to external conductive elements, bus means for electrically connecting a plurality of said coaxial shields, said bus means including a main portion and a plurality of finger-like means extending from said main portion for engaging in generally parallel relationship with and for electrically connecting with respective coaxial shields, and body means for holding said plural contacts and bus means together.

15. A connector as set forth in claim 14, including interconnect means for connecting said bus means to at least one of said plural contacts.

16. A method of terminating flat ribbon insulated coaxial multiconductor cable including multiple conductors and respective coaxial shields therefor, comprising the steps of:

engaging respective fingers of a bus strip with respective coaxial shields while using said fingers to urge respective coaxial shields and their associated conductors out of the plane of the cable as the fingers move towards and into engagement with respective coaxial shields, electrically and mechanically connecting the coaxial shields to respective fingers of the bus strip, electrically connecting the conductors to terminal portions of respective contacts which contact further include connecting portions for electrically connecting with an electrical device, electrically connecting at least one interconnect device of the bus strip to the terminal portion of a respective contact, and molding a strain relief body to and about at least a part of each of the conductors, coaxial shields, bus strip, and electrical junctions between the shields and fingers, the conductors and the contacts and the interconnect device and contact.

17. A method as set forth in claim 16, wherein said engaging step includes using the fingers to cause alternate coaxial shields and their conductors to be urged in a cam-like manner to opposite directions out of the plane of the cable as the fingers move towards and into engagement with respective coaxial shields.

18. A cable termination assembly comprising a flat ribbon insulated coaxial multiconductor cable including multiple conductors and respective coaxial shields therefor; plural contacts having a plurality thereof electrically connected to respective ones of said conductors; bus means for electrically connecting a plurality of said coaxial shields; and body means for holding together said cable, plural contacts and bus means; and wherein said body means holds said plural contacts in a dual-in-line pattern, the contacts in each row are connected to respective conductors alternately with conductors connected to contacts in the other row, said bus means includes a plurality of fingers electrically connected to respective coaxial shields, alternate ones of said fingers engage oppositely disposed sides of respective coaxial shields, alternate ones of said conductors have end portions angled out of the plane of the cable in opposite directions for connection to the contacts in respective rows thereof, and said alternate ones of said fingers are similarly angled for engaging respective coaxial shields at portions thereof coextensive with a part of the end portions of the respective conductors.

19. A cable termination assembly comprising a flat ribbon insulated coaxial multiconductor cable including multiple conductors and respective coaxial shields therefor; plural contacts having a plurality thereof electrically connected to respective ones of said conductors; bus means for electrically connecting a plurality of said coaxial shields; and body means for holding together said cable, plural contacts and bus means; and wherein said bus means includes a main portion extending across the width of said cable and a plurality of fingers arranged generally in a row extending across the width of said cable, said fingers extend generally parallel to and are electrically connected to respective coaxial shields, and alternate ones of said fingers engage oppositely disposed sides of respective coaxial shields.

20. An assembly as set forth in claim 1, wherein alternate ones of said conductors have end portions angled out of the plane of the cable in opposite directions for connection to the contacts in respective rows thereof, and said alternate ones of said fingers are similarly angled for engaging respective coaxial shields at portions thereof coextensive with a part of the end portions of the respective conductors.

21. An electrical cable connector for flat ribbon insulated coaxial multiconductor cable including multiple conductors and respective coaxial shields therefor, said connector comprising plural contact means for electrically connecting respective ones of the conductors to external conductive elements, bus means for electrically connecting a plurality of said coaxial shields, said bus means including a main portion and a plurality of finger-like means extending from said main portion for electrically connecting with respective coaxial shields, said plurality of finger-like means having alternate ones thereof angled in opposite directions with respect to said main portion, and body means for holding said plural contacts and bus means together.

* * * * *

UNITED STATES PATENT AND TRADEMARK OFFICE

CERTIFICATE OF CORRECTION

PATENT NO. 4,781,620

DATED November 1, 1988

INVENTOR(S) John N. Tengler; Roy A. Gobets; Chris A. Shmatovich; and Ross A. Tessien It is certified that error appears in the above-identified patent and that said Letters Patent is hereby corrected as shown below:

Col. 2, line 7 , "contact" should read --contacts--.

Col. 3, line 15, "a" should read --an--.

Col. 3, line 48, "shields" should read --shield--.

Col. 5, line 35, after "lengths" add the word --thereof--.

Col. 5, line 44, delete "and" in the second occurrence and insert --the--.

Col. 5, line 47, "devicdes" should read --devices--.

Col. 6, line 17, "carried" should read --carrier--.

Col. 6, line 47, after "contact" insert --carrier--.

Col. 7, line 10, "67 of" should read --67 from--.

Col. 7, line 39, delete "those" and insert --others--.

<u>Claims:</u>

Claim 2, Col. 7, line 65, "is also" should read --also is--.

UNITED STATES PATENT AND TRADEMARK OFFICE

CERTIFICATE OF CORRECTION

PATENT NO. : 4,781,620

DATED : November 1, 1988

INVENTOR(S) : John N. Tengler et al.

It is certified that error appears in the above-identified patent and that said Letters Patent is hereby corrected as shown below:

Claim 17, Col. 9, line 17, "to" should read -- in --.

Signed and Sealed this

Twenty-first Day of November, 1989

*Attest:*

JEFFREY M. SAMUELS

*Attesting Officer* *Acting Commissioner of Patents and Trademarks*